US005430526A

United States Patent [19]

Ohkubo et al.

[11] Patent Number: 5,430,526

[45] Date of Patent: Jul. 4, 1995

[54] IMAGE FORMING APPARATUS HAVING WEIGHTING MATERIAL IN IMAGE BEARING MEMBER AND PROCESS CARTRIDGE USABLE WITH SAME

[75] Inventors: Masaharu Ohkubo, Yokohama; Hiroki Kisu, Fujisawa; Kazushige Sakurai, Tokyo; Shinichi Tsukida, Okegawa, all of Japan

[73] Assignee: Canon Kabushiki Kaisha, Tokyo, Japan

[21] Appl. No.: 210,740

[22] Filed: Mar. 18, 1994

Related U.S. Application Data

[63] Continuation of Ser. No. 921,689, Jul. 30, 1992, abandoned.

[30] Foreign Application Priority Data

Jul. 31, 1991 [JP] Japan ..... 3-216075

[51] Int. Cl.[6] ..... G03G 15/00

[52] U.S. Cl. ..... 355/211

[58] Field of Search ..... 355/200, 211, 219, 210

[56] References Cited

U.S. PATENT DOCUMENTS 4,023,967 5/1977 McGibbon ..... 355/211 X
4,601,963 7/1986 Takahashi et al. ..... 355/211 X
5,017,965 5/1991 Hashimoto et al. ..... 355/219

FOREIGN PATENT DOCUMENTS 0114863 6/1983 Japan ..... 355/211
0060481 3/1988 Japan ..... 355/211
0153572 6/1988 Japan ..... 355/211
0155169 6/1988 Japan ..... 355/211
0282567 11/1989 Japan ..... 355/211

*Primary Examiner*—Robert B. Beatty
*Attorney, Agent, or Firm*—Fitzpatrick, Cella, Harper & Scinto

[57] ABSTRACT

An image forming apparatus includes a rotatable image bearing member including an image bearing layer and a base member for supporting the image bearing layer; a charging member contactable to the image bearing member for electrically charging the image bearing member; a voltage applying device for applying an oscillating voltage to the charging member; a weighting material inside the base member; and an elastic material between the base member and the weighting material. The elastic material has a hardness not more than 70 degrees (JIS-A), a thickness of 1-5 mm and an outer diameter larger by 40-400 microns than an inner diameter of the base member before it is press-fitted into the base member.

47 Claims, 4 Drawing Sheets

IMAGE FORMING APPARATUS HAVING WEIGHTING MATERIAL IN IMAGE BEARING MEMBER AND PROCESS CARTRIDGE USABLE WITH SAME

This application is a continuation of application Ser. No. 07/921,689 filed Jul. 30, 1992 now abandoned.

FIELD OF THE INVENTION AND RELATED ART

The present invention relates to an image forming apparatus and a process cartridge detachably mountable thereto in which an image forming process is carried out including electric charging or discharging an image bearing member such as an electrophotographic photosensitive member or an electrostatic recording dielectric member as in a laser beam printer or a copying machine using an electrophotographic process or an electrostatic recording system or the like. More particularly, it relates to an image forming apparatus comprising a charging member which is supplied with an oscillating voltage and which is contactable to the image bearing member.

Such a contact type charging means in the form of a charging roller or blade or the like for charging or discharging the image bearing member is advantageous over a non-contact type corona discharger in that the voltage of the voltage source can be reduced, that an amount of corona discharge products such as ozone is small and in that the structure is simple. For this reason, it is more widely used as the charging or discharging means for the image bearing member of the image forming apparatus.

The voltage applied to the charging member is preferably an oscillating voltage in the form of a DC biased AC voltage from the standpoint of the uniformity of the charging. The oscillating voltage is a periodically changing voltage. When the charging member is supplied only with an AC voltage, the image bearing member can be electrically discharged.

However, when the charging operation is carried out by the charging member supplied with the oscillating voltage in the form of a DC-biased AC voltage or in the form of symmetrical AC voltage, so-called "charging noise" is produced by the vibrating movement between the image bearing member and the charging member.

It has been found that an electric field is generated between the charging member supplied with the oscillating voltage and the image bearing member not supplied with such a voltage, and the electric field vibrates the image bearing member and the charging member in the same phase. Thus, the image bearing member and the charging member beat each other to produce the noise. The frequency of the noise is twice the frequency of the alternating voltage applied to the charging member.

Heretofore, the charging noise has been reduced by decreasing the frequency of the oscillating voltage to 100–500 Hz. With the decrease of the frequency, the produced energy is also decreased so that the charging noise becomes less significant. However, the reduction of the frequency may result in charging unevenness (cycle unevenness) due to the oscillating voltage. The cycle unevenness may interfere the scanning line of the laser beam with the result of moire pattern appearing in the resultant image. For this reason, there is a limit to the reduction of the frequency of the oscillating voltage applied to the charging member.

The recent demand is directed to higher speed and less noisy printers. However, in order to prevent the above-described cycle unevenness in a high speed printer, it is required to increase the frequency of the oscillating voltage applied to the charging member, and therefore, the charging noise is a significant problem. Even in the case of low speed printer, lower noise is preferred.

SUMMARY OF THE INVENTION

Accordingly, it is a principal object of the present invention to provide an image forming apparatus and a process cartridge in which the charging noise is low.

It is another object of the present invention to provide an image forming apparatus and a process cartridge in which the charging unevenness is suppressed or prevented.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the preferred embodiments of the present invention will be described.

Figure 1:
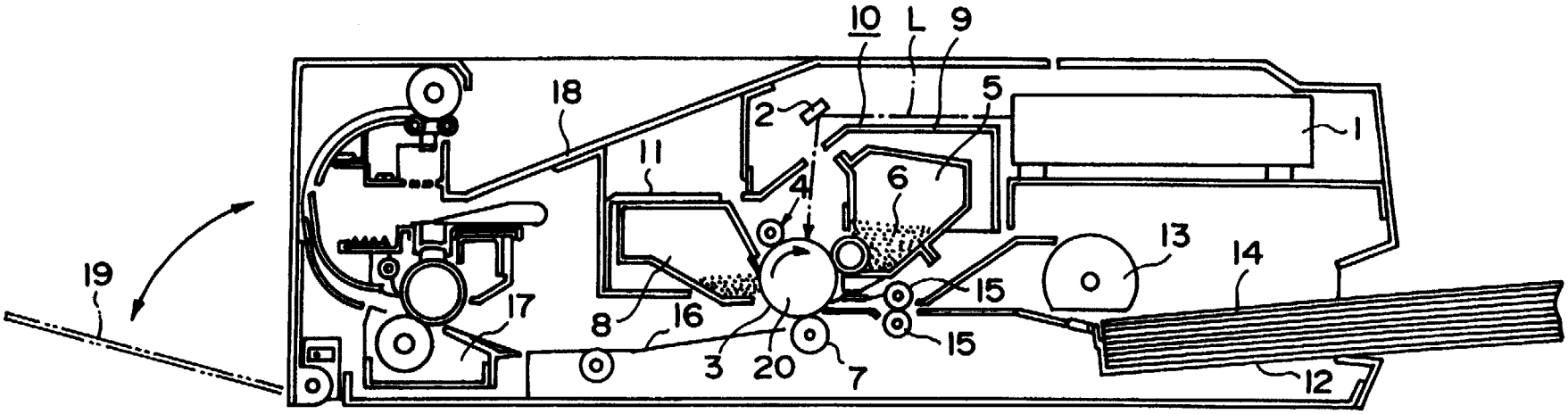
FIG. 1 is a sectional view of an image forming apparatus according to an embodiment of the present invention.
Figure 2:
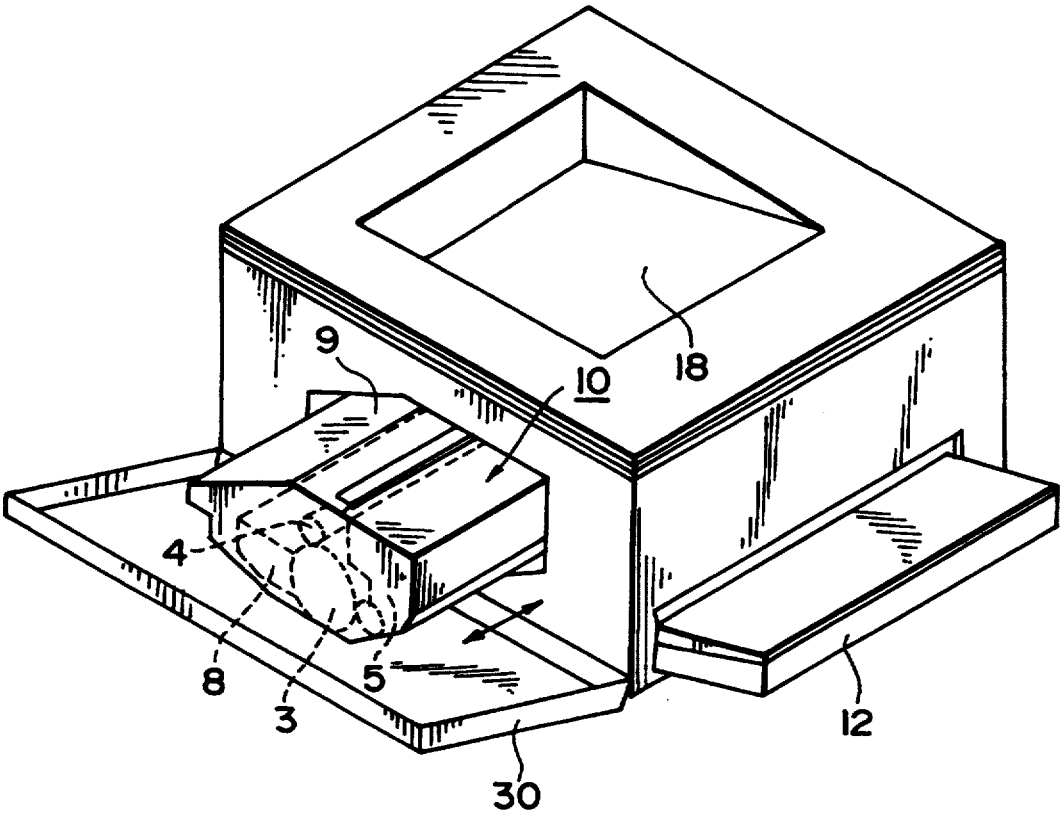
FIG. 2 is a perspective view in which the mounting and demounting operation of the process cartridge relative to the image forming apparatus, is illustrated.

Referring to FIG. 1, there is shown an image forming apparatus according to an embodiment of the present invention, and FIG. 2 is a perspective view of the image forming apparatus, illustrating the mounting and dismounting of the process cartridge.

In this embodiment, the image forming apparatus is in the form of a laser beam printer which uses an image transfer type electrophotographic process and which uses a detachably mountable process cartridge.

As shown in FIG. 1, the image forming apparatus comprises an electrophotographic photosensitive member 3 in the form of a rotatable drum, functioning as an image bearing member. The photosensitive drum 3 is rotated at a predetermined peripheral speed (process speed) in the clockwise direction indicated by an arrow.

In the photosensitive drum 3, there is a weighting material 20, which will be described hereinafter.

Figure 5:
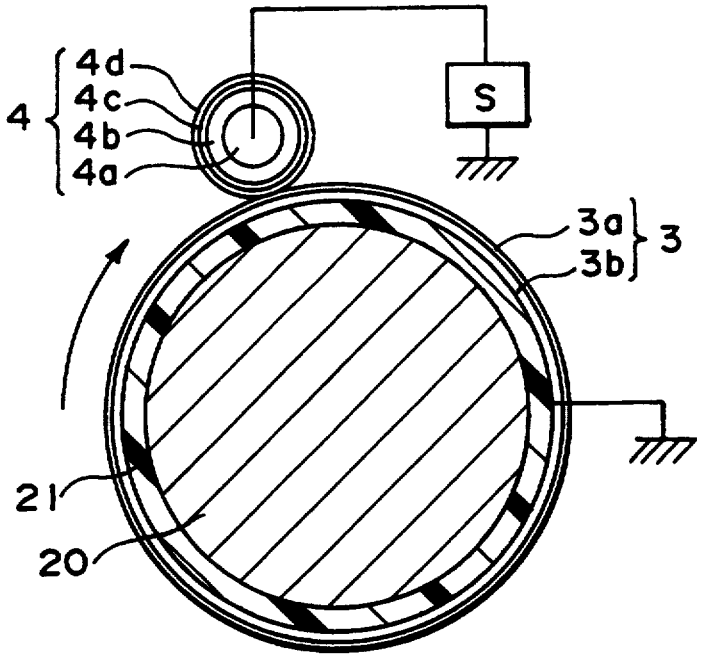
FIG. 5 is a sectional view of a photosensitive member and a charging roller as an exemplary charging member which is contacted to the photosensitive member.

A charging member 4 is press-contacted to the photosensitive drum 3 at a predetermined pressure. The charging member in this embodiment is in the form of a charging roller which is rotated by the rotation of the photosensitive drum 3. As shown in FIG. 5, the charging roller 4 is supplied with a predetermined voltage from a power source S, by which the peripheral surface of the rotating photosensitive drum 3 is uniformly charged or discharged to a predetermined potential of a predetermined polarity.

The charged surface of the rotating photosensitive drum 3 is exposed to a scanning laser beam L by way of a mirror 2, the laser beam L is modulated and emitted from a laser scanner unit 1 in accordance with a time series electric digital picture element signal corresponding to the image information to be recorded. By the exposure, an electrostatic latent image is formed on the peripheral surface of the rotating photosensitive drum 3 in accordance with the projected image information.

The electrostatic latent image is visualized into a toner image with toner 6 in the developing device 5. The toner image is sequentially transferred at the position of the transfer roller 7 onto a transfer material 14 fed between said photosensitive drum 3 and the transfer roller 7. The transfer roller 7 is supplied with a transfer bias voltage of a polarity opposite to that of the toner from an unshown power source, so that the opposite polarity charge is applied to the backside of the transfer material, by which the toner image is transferred from the rotating photosensitive drum 3 onto the transfer material.

A sheet feeding cassette 12 is detachably mountable to the main assembly of the image forming apparatus. The transfer materials 14 in the cassette are fed out one by one by a feeding roller 13 driven in response to a sheet feeding signal and a separation pad (not shown) faced to the roller 13. The transfer material 14 is guided by the top and bottom guides to a pair of registration rollers 15. The registration rollers 15 are not rotated until the transfer material comes thereto. When the leading edge of the transfer material 14 abuts the registration rollers 15, the oblique travel of the transfer material 14 is corrected. The registration rollers 15 starts to rotate to feed the transfer material 14 between the transfer drum 3 and the transfer rollers 7 in synchronism with the leading edge of the image formed on the photosensitive drum 3.

The transfer material 14, having received the toner image in the transfer position, is separated from the surface of the photosensitive drum 3 and is conveyed to an image fixing device 17 by conveying rollers and a conveying guide 16. The fixing device 17 fuses and fixes the toner image on the transfer material 14 by heat and pressure into a recorded image. The transfer material 14, after the image is fixed thereon, is directed to a passage selected by an unshown flapper and is discharged to a discharging tray 18 or 19.

After the image transfer onto the transfer material, the rotating surface of the photosensitive drum 3 is cleaned by a cleaner 8 so that the residual toner or other deposited contaminants are removed so as to be prepared for the next image forming operation.

In the printer of this embodiment, the photosensitive drum 3, four process means, i.e., the photosensitive drum 3, the charging roller 4 actable on the photosensitive drum 3, the developing device 5 and the cleaner 8 are accommodated in a common cartridge frame 9, so that they constitute a process cartridge 10 which is detachably mountable as a unit relative to the main assembly of the printer. When the process cartridge 10 is loaded in or unloaded from the main assembly of the printer, a front door 30 of the main assembly of the printer is opened as shown in FIG. 2 so that the printer main assembly is opened, and the process cartridge 10 is engaged with a guide 11 (FIG. 1) of the main assembly. Then, the process cartridge 10 is inserted into or drawn out of the main assembly along the guide 11. When the process cartridge 10 is sufficiently inserted into the printer main assembly, the process cartridge 10 is mechanically and electrically coupled with the main assembly of the printer.

The voltage applied to the charging member is an oscillating voltage in the form of a DC-biased AC voltage for the purpose of providing uniform charging. Preferably, the peak-to-peak voltage of the oscillating voltage is not less than twice the absolute value of a charge starting voltage relative to the image bearing member. With such a voltage, the uneven charging hardly occurs in a regular development or a reverse development process.

The waveform of the oscillating voltage is not limited to a sine wave, but it may be a rectangular, triangular, pulse wave or the like. The oscillating voltage may be, for example, a rectangular wave voltage provided by periodically rendering on and off a DC voltage source.

When a symmetrical oscillating voltage is applied to the charging member, the image bearing member can be electrically discharged (charge removal).

Figure 3:
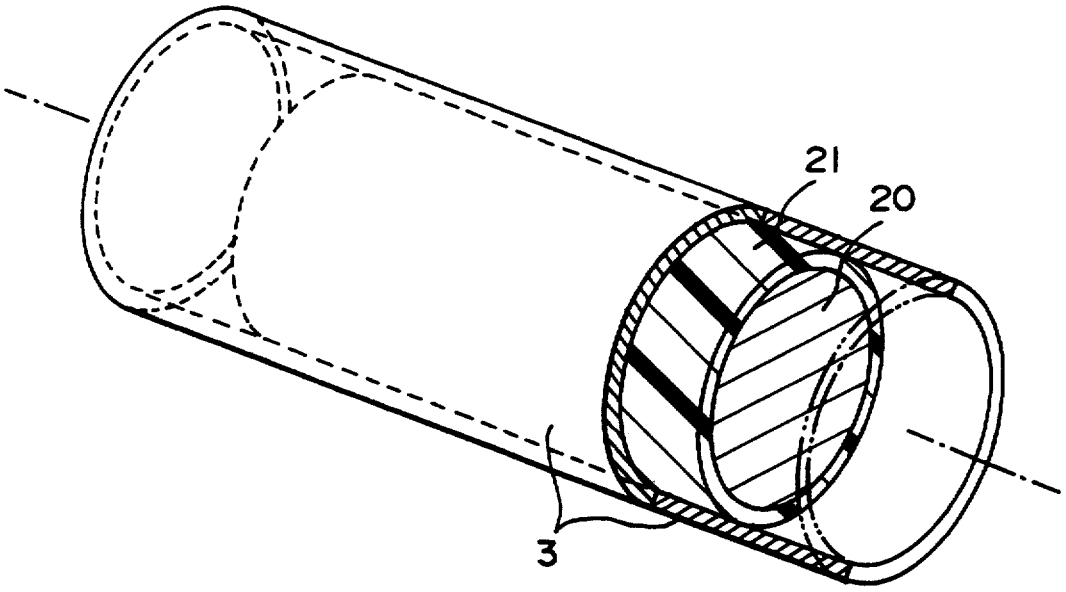
FIGS. 3 and 4 are cut-away perspective views of photosensitive drums.
Figure 4:
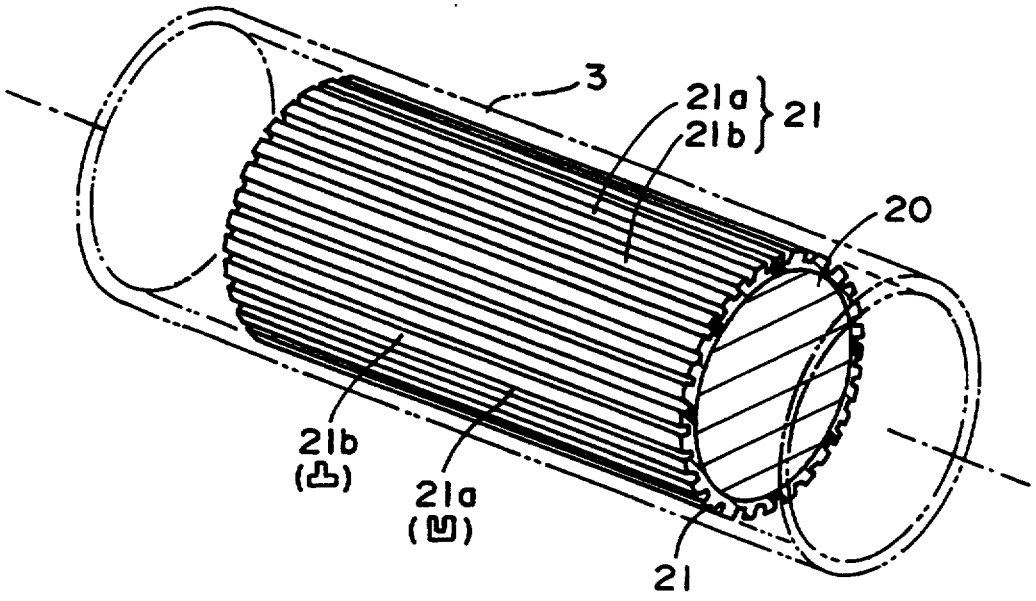

Referring to FIGS. 3, 4 and 5, the photosensitive drum 3 will be described in further detail.

The photosensitive drum 3 comprises an aluminum cylinder **3*b* (base member) and an image bearing layer 3*a* of several tens of microns thick applied on the outer peripheral surface of the cylinder 3*b*, the image bearing layer 3*a* including a conductive layer, a photosensitive layer, a charge transporting layer or the like. The aluminum cylinder is electrically grounded. The thickness of the aluminum cylinder is preferably 0.5–2.0 mm from the standpoint of the performance and cost. The length of the photosensitive drum 3** is about 250 mm to cover A4 size transfer material.

Within the aluminum cylinder **3*b*, there is a columnar weighting material 20 coated with an elastic layer 21. The weighting material 20** is press-fitted therein.

The weighting member 20 is in the form of a rigid material such as metal which may be aluminum, brass, steel, lead, sand hermetically contained in a container, sintered clay, plastic resin material or the like, provided that it has appropriate weight. However, water which may leak, a material which may produce monomer influential to the photosensitive drum, or the like, are not preferable. It is preferable that the weight of the weighting member 20 is larger than that of the photosensitive drum 3 itself. Empirically, the proper weight is 100–500 g. If it is lighter than the photosensitive drum, the vibration suppressing effect is not enough. If it is too heavy, the rotational torque required for rotation of the photosensitive drum 3 may become too great. The preferable configuration of the weighting member 20 is columnar in consideration of the configuration of the inside of the photosensitive drum 3.

The material usable for the elastic layer 21 include silicone rubber, urethane rubber, chloroprene rubber, NBR (nitrile butadiene rubber), SBR (styrene butadiene rubber), EPDM (tercopolymer of ethylene propylene diene) or another rubber material. Among them, silicone rubber, urethane rubber and EPDM rubber are preferable in consideration of the small amount of production of monomer influential to the photosensitive drum 3.

The thickness of the elastic layer 21 is preferably 1–5 mm. The outside diameter of the weighting member 20 including the rubber layer 21 is slightly larger than the inside diameter of cylinder 3b before it is inserted into the photosensitive drum 3 (the difference is preferably 40–400 microns). Thus, the weighting member 20 with the rubber layer 21 can be inserted into the cylinder 3b because of the elasticity of the rubber layer 21 resulting from the difference between the inside diameter and the outside diameter. Then, the outer peripheral surface of the rubber layer 21 is closely contacted to the inside surface of the cylinder 3b by the elasticity of the rubber layer so that the weighting member 20 is stably accommodated and sustained in the cylinder.

Since the weighting material having the elastic material fills the inside space of the base member of the photosensitive drum 3, the possible thermal expansion of the weighting material due to the ambient condition change such as the temperature rise, can be accommodated by the elastic material, and therefore, the base member is prevented from deformation.

The elastic member 21 is effective to fix the weighting member 20 in the photosensitive drum 1 and to transmit the vibration of the photosensitive drum 3 to the weighting member 20. When the hardness is smaller than 20 degrees (JIS-A hardness), the weighting member 20 does not match the vibration of the photosensitive drum 3, thereby decreasing the vibration suppressing effect. Therefore, the hardness is preferably not less than 20 degrees. If it is larger than 70 degrees (JIS-A hardness), it becomes difficult to insert the weighting material into the photosensitive drum. In view of this, the hardness is preferably not more than 70 degrees.

By pressing such a weighting member 20 with the elastic layer 21 into the photosensitive drum, the weighting member 20 is fixed in the photosensitive drum.

In the embodiment shown in FIG. 4, the elastic layer 21 covering the outer periphery of the weighting member 20 is provided with a large number of-longitudinal parallel pits and projections 21a and 21b, respectively, on its peripheral surface. With these projections, the insertion of the weighting member 20 into the photosensitive drum is made easier. In addition, the outer end portions of the projections 21b of the elastic layer 21 are deformed to closely contact the inside surface of the photosensitive drum. Therefore, the weighting member 20 is securedly fixed inside the photosensitive drum. The ratio of the longitudinal projections 21b and the longitudinal pits 21a is preferably such that the projections 21b occupy not less than 50% of the entire circumferential surface from the standpoint of maintaining sufficient contact area between the outer peripheral surface of the elastic layer 21 and the inside surface of the photosensitive drum in order to effectively suppress the vibration.

The outer diameter between free ends of the projections 21b of the elastic layer 21 is preferably larger than the inside diameter of the photosensitive drum 3 by 0.1–0.9 mm when it is not inserted into the photosensitive drum.

Referring to FIG. 5, the charging roller 4 comprises a conductive core metal 4a made of aluminum, steel or the like, a conductive layer 4b thereon, a high resistance layer 4c thereon and a protection layer 4d. The conductive layer 4b may be of urethane rubber or EPDM rubber. The high resistance layer 4c may be of hydrin rubber having a higher volume resistivity than the conductive layer 4b for the purpose of preventing electric current leakage. The protection layer 4c is effective to prevent permeation of plasticizer from the charging roller 4 to the drum 3, and in view of this, it is made of N-methoxymethyl nylon.

EXAMPLE 1

The process speed of the photosensitive drum 3 was 50 mm/sec. The charging roller (charging member) 4 had an outer diameter of 12 mm and was driven by the rotation of the photosensitive drum 3. The charging roller 4 was supplied with an oscillating voltage having a peak-to-peak voltage of 2000 V and having a frequency of 500 Hz. The photosensitive drum 3 comprised an aluminum cylinder having an outer diameter of 30 mm and a thickness of 0.7 mm. The surface thereof was coated with photosensitive layer having a thickness of 45 microns in total. The weight of the photosensitive drum 3 was approximately 50 g.

The weighting material 20 was made of solid brass having a weight of 200 g and an outer diameter of 24 mm. The outer periphery thereof was coated with silicone rubber layer 21 of 50 degrees hardness (JIS-A) so as to provide an outer diameter of 28.8 mm.

The process cartridge 10 was assembled using the photosensitive drum 3 containing therein the weighting member 20 and the elastic layer 21. Then, the laser beam printer was operated for the printing operation. The noise level decreased by 3–5 dB as compared with the noise level without the weighting material. The noise level without the weighting material was 52 dB in accordance with paragraph 6 of ISO 7779.

EXAMPLE 2

Process speed was 100 mm/sec. The charging roller 4 had an outer diameter of 12 mm and was driven by rotation of the photosensitive drum 3. The charging roller 4 was supplied with an oscillating voltage having a peak-to-peak voltage of 2000 V and a frequency of 900 Hz. The photosensitive drum 3 comprised an aluminum cylinder having an outer diameter of 30 mm and a thickness of 0.7 mm. The surface thereof was coated with a photosensitive layer having a thickness of 45 microns in total. The weight of such a photosensitive drum 3 was approximately 50 g.

The weighting material 20 was made of solid brass (columnar) of 200 g and 24 mm in the outer diameter. The outer periphery thereof was wrapped with silicone rubber layer 21 of 50 degrees hardness so as to provide an outer diameter of 28.8 mm.

The process cartridge 10 was assembled, using the photosensitive drum 3 containing the weighting member 20 and the elastic layer 21. Then, the laser beam printer was operated with the process cartridge 10 for printing operation, the noise level was reduced by 3–5 dB as compared with the photosensitive drum 3 without the weighting material.

EXAMPLE 3

The process speed was 30 mm/sec. The outer diameter of the charging roller 4 was 12 mm and was driven by the rotation of the photosensitive drum 3. The charging roller 4 was supplied with an oscillating voltage having a peak-to-peak voltage of 1500 V and a frequency of 250 Hz. The photosensitive drum 3 included an aluminum cylinder having an outer diameter of 24 mm and a thickness of 0.7 mm. The surface thereof was coated with a photosensitive layer having a thickness of 45 microns in total. The weight of the photosensitive drum 3 was approximately 40 g.

The weighting material 20 was made of solid brass (columnar) of 180 g and 18 mm outer diameter. The outer surface thereof was wrapped with silicone rubber 21 of 50 degrees hardness so as to provide an outer diameter of 22 mm.

The process cartridge 10 was assembled using such a photosensitive drum 3 containing the weighting member 20 and the elastic layer 21. Then, the laser beam printer with such a process cartridge 10 was operated for the printing operation. The noise level was reduced by 3-5 dB as compared with the case of the photosensitive drum 3 without the weighting material.

EXAMPLE 4

Figure 6:
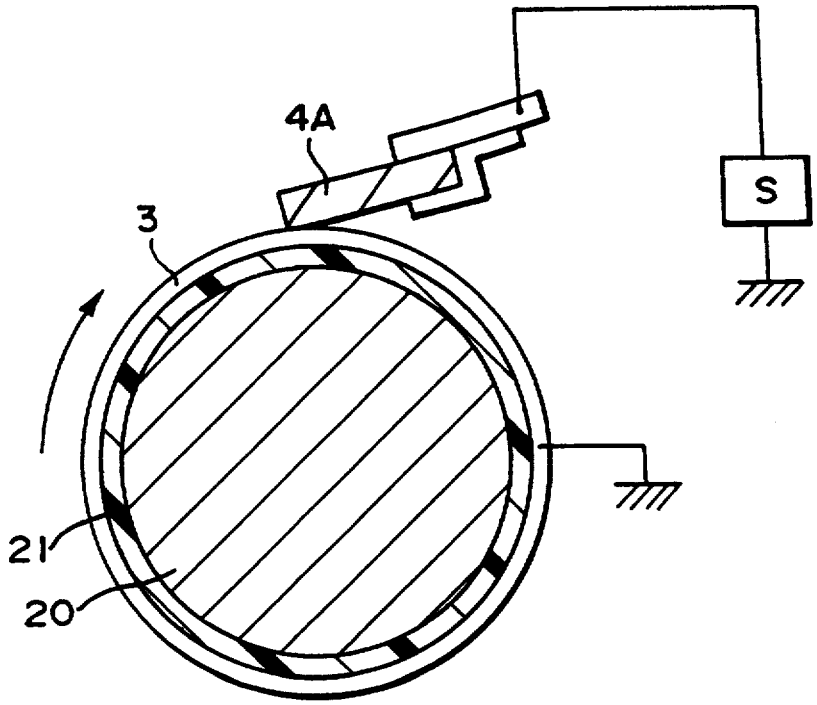
FIG. 6 is a sectional view of a photosensitive member and a charging blade as an exemplary charging member which is contacted to said photosensitive member.

The photosensitive drum 3 included an aluminum cylinder having an outer diameter of 30 mm, a length of 250 mm and a thickness of 0.8 mm and a photosensitive layer thereon. The weight of the photosensitive drum 3 was approximately 55 g. The charging member was in the form of a semiconductive rubber blade 4A having a thickness of 2 mm as shown in FIG. 6. The photosensitive member was incorporated in a laser beam printer having a process speed of approximately 50 mm/sec. The charging blade 4A was supplied with an oscillating voltage having a DC component of −700 V and an AC component having a frequency of 600 Hz and a peak-to-peak voltage of 1500 V. The power was supplied from a power source S. The laser beam printer was operated for printing operation, and the noise level was 52 dB.

Then, the inside of the photosensitive drum was filled with a weighting member 20 of columnar brass of 150 g. The circumferential periphery of the weighting member 20 was coated with an elastic layer 21 of urethane rubber having a hardness of 30 degrees. The outer diameter of the urethane rubber layer 21 was made slightly larger than the inside diameter of the photosensitive drum. Then, the weighting material 20 was pressed into the photosensitive drum. The laser beam printer was operated with such a photosensitive drum 3, the measured noise level was 45 dB.

EXAMPLE 5

The photosensitive drum 3 included an aluminum cylinder having an outer diameter of 24 mm. A length of 250 mm and a thickness of 0.8 mm and a photosensitive layer. The weight of the photosensitive drum 3 was approximately 45 g. The charging member was in the form of a semiconductive rubber blade 4A having a thickness of 2 mm as shown in FIG. 6. The charging blade was incorporated in a laser beam printer having a process speed of approximately 30 mm/sec. The charging blade 4*a* was supplied with an oscillating voltage having a DC component of −700 V and an AC component having a frequency of 300 Hz and a peak-to-peak voltage of 1500 V. The laser beam printer was operated for printing operation, and the noise level was measured which was 52 dB.

The inside space of the photosensitive drum 3 was filled with a weighting member 20 of columnar brass of 150 g coated with an elastic layer 21 of urethane rubber having a hardness of 30 degrees. The outer diameter thereof was slightly larger than the inside diameter of the photosensitive drum. It was pressed into the photosensitive drum. The laser beam printer was operated in the same manner except for the use of the photosensitive drum 3 with the weighting material. The noise level was reduced to 45 dB.

EXAMPLE 6

The process speed was 50 mm/sec. The charging roller 3 had an outer diameter of 12 mm and was driven by rotation of the photosensitive drum. The charging roller 3 was supplied with an oscillating voltage having a frequency of 500 Hz and a peak-to-peak voltage of 2000 V. The photosensitive drum 3 included an aluminum cylinder having a outer diameter of 30 mm and a thickness of 0.7 mm. The outer surface thereof was coated with a photosensitive layer having a thickness of 45 microns in total. The weight of the photosensitive drum 3 was approximately 50 g.

The weighting member 20 was made of a brass columnar member having an outer diameter of 24 mm and a weight of 200 g, and was coated with an elastic layer 21 made of silicone rubber. The rubber layer 21 had longitudinal ribs or projections 21*b* to provide an outer diameter of 28.80 mm, as shown in FIG. 4. The area ratio of the ribs 21*b* was 50%.

Using the photosensitive drum 3 having the weighting member 20 and the elastic layer 21, a process cartridge 10 was assembled, and the process cartridge was incorporated in a laser beam printer. Then, the laser beam printer was operated for printing operation, the noise level was reduced by 3-5 dB as compared with the case of the photosensitive drum 3 without the weighting material.

As will be understood from Example 6, the rubber layer 21 with the longitudinal ribs 21*a* does not deteriorate the noise suppressing effect, as compared with the Examples 1-5.

As will be understood from the foregoing, according to the present invention, the vibration of the charging member and the image bearing member during the charging operation is suppressed by the inside weighting material in the image bearing member. This has been confirmed when the image bearing member vibration is observed by a spectrum analyzer. Particularly, the weighting material is effective to suppress the vibration having the frequency of twice the frequency of the AC component applied to the charging member and to suppress a higher frequency generated with the twice frequency, and therefore, the unwanted noise can be suppressed.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

a rotatable image bearing member comprising an image bearing layer and a base member for supporting said image bearing layer;

a charging member contactable to said image bearing member for electrically charging said image bearing member; and a voltage applying means for applying an oscillating voltage to said charging member;

wherein said image bearing member further comprises a weighting material disposed inside said base member, said weighting material having a weight larger than the combined weight of said image bearing layer and said base member, and an elastic material disposed between and in contact with said base member and said weighting material, wherein said elastic material has a hardness of not more than 70 degrees, JIS-A.

2. An apparatus according to claim 1, wherein said elastic material contacts said base member entirely in the circumferential direction.

3. An apparatus according to claim 1 or 2, wherein said weighting material is press-fitted with said elastic material therebetween.

4. An apparatus according to claim 3, wherein said elastic material has plural projections contactable to an inside of said base member.

5. An apparatus according to claim 4, wherein the projections extend in a longitudinal direction.

6. An apparatus according to claim 4, wherein said projections occupy not less than 50% of total surface area of said elastic material.

7. An apparatus according to claim 1, wherein said elastic material has a hardness of not less than 20 degrees, JIS-A.

8. An apparatus according to claim 1, wherein said base member is in the form of a cylinder, and said weighting material is in a columnar form, and the outer circumferential periphery of the weighting material is covered with said elastic material.

9. An apparatus according to claim 8, wherein said weighting material is press-fitted in said base member together with said elastic material.

10. An apparatus according to claim 9, wherein an outer diameter of said elastic member is larger than an inner diameter of said base member by 40–400 microns before it is press-fitted into said base member.

11. An apparatus according to claim 9, wherein said elastic material has plural projections contactable to an inside of said base member.

12. An apparatus according to claim 11, wherein the projections extend in a longitudinal direction.

13. An apparatus according to claim 1, wherein said elastic layer has a thickness of 1–5 mm.

14. An apparatus according to claim 1, wherein said charging member is a roller.

15. An apparatus according to claim 1, wherein said elastic material is capable of absorbing thermal expansion of said weighting material.

16. A process cartridge detachably mountable to an image forming apparatus, comprising:

a rotatable image bearing member comprising an image bearing layer and a base member for supporting said image bearing layer; and a charging member contactable to said image bearing member for electrically charging said image bearing member, said charging member being adapted for receiving an oscillating voltage;

wherein said image bearing member further comprises a weighting material disposed inside said base member, said weighting material having a weight larger than the combined weight of said image bearing layer and said base member, and an elastic material disposed between and in contact with said base member and said weighting material, wherein said elastic material has a hardness of not more than 70 degrees, JIS-A.

17. A process cartridge according to claim 16, wherein said elastic material is capable of absorbing thermal expansion of said weighting material.

18. A rotatable image bearing member which is electrostatically charged by a charging member which is contactable to said image bearing member and supplied with an oscillating voltage, comprising:

an image bearing layer;

a base member for supporting the image bearing layer;

a weighting material disposed inside said base member and having a weight larger than the combined weight of said image bearing layer and said base member; and an elastic material disposed between and in contact with said base member and said weighting material, wherein said elastic material has a hardness of not more than 70 degrees, JIS-A.

19. A member according to claim 18, wherein said elastic material is capable of absorbing thermal expansion of said weighting material.

20. An image forming apparatus, comprising:

a rotatable image bearing member comprising an image bearing layer and a base member for supporting said image bearing layer;

a charging member contactable to said image bearing member for electrically charging said image bearing member; and a voltage applying means for applying an oscillating voltage to said charging member;

wherein said image bearing member further comprises a weighting material disposed inside said base member, said weighting material having a weight larger than the combined weight of said image bearing layer and said base member, and an elastic material disposed between and in contact with said base member and said weighting material, wherein said elastic material has a thickness of 1–5 mm.

21. An apparatus according to claim 20, wherein said elastic material contacts said base member entirely in the circumferential direction.

22. An apparatus according to claim 20 or 21, wherein said weighting material is press-fitted with said elastic material therebetween.

23. An apparatus according to claim 20, wherein said elastic material has a hardness of not less than 20 degrees, JIS-A.

24. An apparatus according to claim 22, wherein an outer diameter of said elastic member is larger than an inner diameter of said base member by 40–400 microns before it is press-fitted into said base member.

25. An apparatus according to claim 22, wherein said elastic material has plural projections contactable to an inside of said base member.

26. An apparatus according to claim 25, wherein the projections extend in a longitudinal direction.

27. An apparatus according to claim 20, wherein said charging member is a roller.

28. An apparatus according to claim 25, wherein said projections occupy not less than 50% of total surface area of said elastic material.

29. An apparatus according to claim 20, wherein said elastic material is capable of absorbing thermal expansion of said weighting material.

30. A process cartridge detachably mountable to an image forming apparatus, comprising:

a rotatable image bearing member comprising an image bearing layer and a base member for supporting said image bearing layer; and a charging member contactable to said image bearing member for electrically charging said image bearing member, said charging member being adapted for receiving an oscillating voltage;

wherein said image bearing member further comprises a weighting material disposed inside said base member, said weighting material having a weight larger than the combined weight of said image bearing layer and said base member, and an elastic material disposed between and in contact with said base member and said weighting material, wherein said elastic material has a thickness of 1–5 mm.

31. A process cartridge according to claim 30, wherein said elastic material is capable of absorbing thermal expansion of said weighting material.

32. A rotatable image bearing member which is electrostatically charged by a charging member which is contactable to said image bearing member and supplied with an oscillating voltage, comprising:

an image bearing layer;

a base member for supporting the image bearing layer;

a weighting material disposed inside said base member and having a weight larger than the combined weight of said image bearing layer and said base member; and an elastic material disposed between and in contact with said base member and said weighting material, wherein said elastic layer has a thickness of 1–5 mm.

33. A member according to claim 32, wherein said elastic material is capable of absorbing thermal expansion of said weighting material.

34. An image forming apparatus, comprising:

a rotatable image bearing member comprising an image bearing layer and a base member for supporting said image bearing layer;

a charging member contactable to said image bearing member for electrically charging said image bearing member; and a voltage applying means for applying an oscillating voltage to said charging member;

wherein said image bearing member further comprises a weighting material disposed inside said base member, said weighting material having a weight larger than the combined weight of said image bearing layer and said base member, and an elastic material disposed between and in contact with said base member and said weighting material, wherein said weighting material is press-fitted in said base member together with said elastic material, wherein an outer diameter of said elastic material is larger than an inner diameter of said base member by 40–400 microns before it is press-fitted into said base member.

35. An apparatus according to claim 34, wherein said elastic material contacts said base member entirely in the circumferential direction.

36. An apparatus according to claim 34, wherein said elastic material has a hardness of not less than 20 degrees, JIS-A.

37. An apparatus according to claim 34, wherein said elastic material has plural projections contactable to an inside of said base member.

38. An apparatus according to claim 37, wherein the projections extend in a longitudinal direction.

39. An apparatus according to claim 34, wherein said charging member is a roller.

40. An apparatus according to claim 36, wherein said elastic material has plural projections contactable to an inside of said base member.

41. An apparatus according to claim 40, wherein the projections extend in a longitudinal direction.

42. An apparatus according to claim 37, wherein said projections occupy not less than 50% of total surface area of said elastic material.

43. An apparatus according to claim 34, wherein said elastic material is capable of absorbing thermal expansion of said weighting material.

44. A process cartridge detachably mountable to an image forming apparatus, comprising:

a rotatable image bearing member comprising an image bearing layer and a base member for supporting said image bearing layer; and a charging member contactable to said image bearing member for electrically charging said image bearing member, said charging member being adapted for receiving an oscillating voltage;

wherein said image bearing member further comprises a weighting material disposed inside said base member, said weighting material having a weight larger than the combined weight of said image bearing layer and said base member, and an elastic material disposed between and in contact with said base member and said weighting material, wherein said weighting material is press-fitted in said base member together with said elastic material, wherein an outer diameter of said elastic material is larger than an inner diameter of said base member by 40–400 microns before it is press-fitted into said base member.

45. A process cartridge according to claim 44, wherein said elastic material is capable of absorbing thermal expansion of said weighting material.

46. A rotatable image bearing member which is electrostatically charged by a charging member which is contactable to said image bearing member and supplied with an oscillating voltage, comprising:

an image bearing layer;

a base member for supporting the image bearing layer;

a weighting material disposed inside said base member and having a weight larger than the combined weight of said image bearing layer and said base member; and an elastic material disposed between and in contact with said base member and said weighting material, wherein said weighting material is press-fitted in said base member together with said elastic material, wherein an outer diameter of said elastic material is larger than an inner diameter of said base member by 40–400 microns before it is press-fitted into said base member.

47. A member according to claim 46, wherein said elastic material is capable of absorbing thermal expansion of said weighting material.

* * * * *

UNITED STATES PATENT AND TRADEMARK OFFICE

CERTIFICATE OF CORRECTION

PATENT NO. : 5,430,526

DATED : July 4, 1995

INVENTOR(S) : Ohkubo et al.

It is certified that error appears in the above-indentified patent and that said Letters Patent is hereby corrected as shown below:

On the title page item,

[56] FOREIGN PATENT DOCUMENTS:

"0114863 6/1983 Japan" should read --0114863 6/1985 Japan--.

COLUMN 5:

Line 40, "of-longitudinal" should read --of longitudinal--.

Signed and Sealed this

Third Day of October, 1995

Bruce Lehman

*Attest:*

BRUCE LEHMAN

*Attesting Officer*

*Commissioner of Patents and Trademarks*